US012544822B2

(12) United States Patent
Leinweber

(10) Patent No.: US 12,544,822 B2
(45) Date of Patent: Feb. 10, 2026

(54) FOLD FORMING TOOL, FOLD FORMING DEVICE, METHOD FOR PRODUCING A FOLDED/BONDED CONNECTION, AND VEHICLE WITH FOLDED/BONDED CONNECTION

(71) Applicant: Bayerische Motoren Werke Aktiengesellschaft, Munich (DE)

(72) Inventor: Stefan Leinweber, Herrsching am Ammersee (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 36 days.

(21) Appl. No.: 18/698,431

(22) PCT Filed: Dec. 8, 2022

(86) PCT No.: PCT/EP2022/084947
§ 371 (c)(1),
(2) Date: Apr. 4, 2024

(87) PCT Pub. No.: WO2023/104954
PCT Pub. Date: Jun. 15, 2023

(65) Prior Publication Data

US 2025/0235920 A1 Jul. 24, 2025

(30) Foreign Application Priority Data

Dec. 9, 2021 (DE) ..... 10 2021 132 428.9

(51) Int. Cl.
*B21D 39/02* (2006.01)
*B21D 53/88* (2006.01)
*B21D 39/00* (2006.01)

(52) U.S. Cl.
CPC ..... *B21D 39/021* (2013.01); *B21D 53/88* (2013.01); *B21D 39/00* (2013.01); *B21D 39/02* (2013.01);
(Continued)

(58) Field of Classification Search
CPC .... B21D 39/021; B21D 39/023; B21D 39/00; B21D 39/02; Y10T 29/49906; Y10T 29/49915; Y10T 29/49966
See application file for complete search history.

(56) References Cited

U.S. PATENT DOCUMENTS 5,237,734 A * 8/1993 Polon ..... B21D 39/02 29/243.58
5,470,416 A * 11/1995 Herring, Jr. ..... F16B 11/006 156/196
(Continued)

FOREIGN PATENT DOCUMENTS

DE 19504482 A1 * 8/1996 ..... B21D 39/02
DE 10 2006 010 469 A1 9/2007
(Continued)

OTHER PUBLICATIONS

International Search Report (PCT/ISA/210) issued in PCT Application No. PCT/EP2022/084947 dated Jun. 15, 2023 with English translation (10 pages).
(Continued)

*Primary Examiner* — Jermie E Cozart
(74) *Attorney, Agent, or Firm* — Crowell & Moring LLP

(57) ABSTRACT

A fold forming tool has a main body with a longitudinal axis and an active surface which is configured to fold over a flange, bent over from a metal sheet, onto the metal sheet by way of movement of the fold forming tool in the direction of the longitudinal axis along the flange in a working direction. The active surface extends in the direction of the
(Continued)

longitudinal axis of the main body and is formed as a helical surface which is produced by way of a straight line being wound around a straight or curved helical axis, wherein the straight-line intersects the helical axis at an acute angle, as viewed in the working direction.

4 Claims, 7 Drawing Sheets

(52) U.S. Cl.
CPC ..... *B21D 39/023* (2013.01); *Y10T 29/49906* (2015.01); *Y10T 29/49915* (2015.01); *Y10T 29/49966* (2015.01)

(56) References Cited

U.S. PATENT DOCUMENTS

| | | | | |
|---|---|---|---|---|
| 6,578,404 | B1 * | 6/2003 | Rousseau | B21D 39/02 72/413 |
| 6,609,406 | B1 | 8/2003 | Staquet | |
| 2004/0245676 | A1 | 12/2004 | Zaluzec et al. | |
| 2005/0060866 | A1 * | 3/2005 | Westall | B21D 39/021 156/275.3 |
| 2006/0179914 | A1 * | 8/2006 | Tocco | B21D 39/021 72/447 |
| 2009/0301160 | A1 | 12/2009 | Baumgarten et al. | |
| 2012/0248810 | A1 | 10/2012 | Song et al. | |
| 2013/0129410 | A1 | 5/2013 | Stefani et al. | |
| 2015/0047178 | A1 * | 2/2015 | Wanintradul | B21D 39/021 72/470 |
| 2015/0224757 | A1 | 8/2015 | Sassmannshausen et al. | |

FOREIGN PATENT DOCUMENTS

| | | | | | |
|---|---|---|---|---|---|
| DE | 10 2014 015 020 | A1 | | 4/2015 | |
| DE | 10 2019 220 106 | A1 | | 6/2021 | |
| EP | 1 074 416 | A2 | | 2/2001 | |
| EP | 3 419 774 | B1 | | 12/2019 | |
| FR | 2 987 290 | A1 | | 8/2013 | |
| FR | 2990887 | A1 | * | 11/2013 | B21D 19/02 |
| FR | 3047913 | A1 | * | 8/2017 | B21D 19/02 |
| FR | 3 067 621 | A1 | | 12/2018 | |
| FR | 3 097 144 | A1 | | 12/2020 | |
| FR | 3 101 266 | A1 | | 4/2021 | |
| FR | 3112299 | A1 | * | 1/2022 | B21D 39/021 |
| JP | 2000-5834 | A | | 1/2000 | |
| JP | 2004298929 | A | * | 10/2004 | B21D 39/021 |
| WO | WO-0058041 | A1 | * | 10/2000 | B21D 39/021 |

OTHER PUBLICATIONS

German-language Written Opinion (PCT/ISA/237) issued in PCT Application No. PCT/EP2022/084947 dated Jun. 15, 2023 with English translation (14 pages).

German-language Search Report issued in German Application No. 10 2021 132 428.9 dated Oct. 31, 2022 with partial English translation (12 pages).

* cited by examiner

FOLD FORMING TOOL, FOLD FORMING DEVICE, METHOD FOR PRODUCING A FOLDED/BONDED CONNECTION, AND VEHICLE WITH FOLDED/BONDED CONNECTION

BACKGROUND AND SUMMARY

The invention relates to a fold forming tool, to a fold forming device, to a method for producing a folded/bonded connection, and to a vehicle with a folded/bonded connection.

Folded/bonded connections are used in order, for example, to connect two components to each other. For this purpose, a flange on the edge of an outer panel is folded over the edge region of an inner panel. This can be undertaken, for example, by means of roll crimping, for which purpose a crimping roller is guided along the component to be crimped and bends over the flange in the direction of the outer panel. To obtain high connection strengths, prior to the folding an adhesive is additionally inserted in the region of the folded connection between the components, the adhesive filling the folding seam arising during the joining process. The adhesive bond significantly increases the strength and rigidity of the assembly.

A method for producing a folded connection by roll crimping and a crimping apparatus suitable for this purpose are known, for example, from the document DE 10 2006 010 469 A1. The crimping apparatus has a crimping bed for receiving a workpiece, and an industrial robot, the hand of which bears a crimping tool with at least one crimping roller. The crimping is undertaken in a plurality of crimping steps, with a roller in the form of a cone or a truncated cone being used here as a pre-crimping roller. Either the same crimping roller or a crimping roller with a cylindrical shape is used as a finish-crimping roller for closing the crimped fold. If such a crimping apparatus is used for producing a folded/bonded connection in the case of vehicle components, when the crimped fold is closed the outer panel is pressed onto the inner panel. In the process, a nozzle-shaped gap is formed, from which the adhesive escapes at very high speed and soils the components.

The edge region of the components is conventionally machined by a cutting operation, as a result of which the component edges are not protected against corrosion and are therefore susceptible to corrosion. In order nevertheless to produce sufficient corrosion protection here, provision may be made to provide the component edges retrospectively with PVC sealing as protection against corrosion. This is complicated and expensive. In addition, such PVC sealings have a tendency to form air pockets which require subsequent work. Such sealed folded/bonded connections do not satisfy the visual requirements imposed on an outer skin component.

Furthermore, there are endeavors to be able to form folded/bonded connections, which are arranged in the visible region of a vehicle body, with such a high surface quality that cladding or laminating of the folded/bonded connection may be omitted. In this connection, there is the additional challenge that the construction space in the case of vehicle components with a complex shape, e.g. a side frame, is limited and the folded/bonded connection has to be formed at locations to which access is difficult.

Against this background, it is an object of the invention to provide a solution as to how a folded/bonded connection can be formed with improved surface quality. The solution is intended to be usable in particular even in the event of limited construction space. In particular, the protection against corrosion is intended to be improved in a simple manner. In a further aspect, the solution is intended to be suitable for mass production.

The object is achieved by a fold forming tool, by a fold forming device, by a method, and by a vehicle, according to the independent claims. Further advantageous refinements emerge from the dependent claims and the description below.

A fold forming tool having a main body with a longitudinal axis is specified. The main body can be formed in one part or multiple parts. The main body is preferably used for fastening the fold forming tool to an industrial robot and can be correspondingly designed.

The fold forming tool furthermore has an active surface, which is designed to fold over a flange, which is bent over from a metal sheet, onto the metal sheet by movement of the fold forming tool along the flange in the direction of the longitudinal axis in a working direction. For this purpose, the active surface extends in the direction of the longitudinal axis of the main body. The active surface is in the form of a helical surface which is produced by screwing of a straight line around a rectilinear or a curved helical axis, wherein the straight line intersects the helical axis at an acute angle—as viewed in the working direction of the fold forming tool. As viewed in the working direction of the fold forming tool, the straight line is inclined at an acute angle to the helical axis, as a result of which the outermost point of the straight line is set back in the screwing direction in relation to an inner point of the straight line. A vector which is arranged on the straight line and points away perpendicularly from the helical surface then points away from the helical axis into the space. This vector corresponds to the force vector which, during use of the tool, acts on the flange which is to be bent over. A helical surface configured in such a way ensures that the force vector always points outward and therefore in the direction of the trimmed edge. This results in a laminar outlet of adhesive at the trimmed edge. For example, the angle of inclination by which the straight line intersects the helical axis lies in the range of 20 to 70 degrees and in particular in the range of 50 to 70 degrees and particularly preferably 60°. In order to produce the helical surface, the straight line is screwed by a predetermined angle of rotation about the helical axis. The angle by which the helical surface or active surface is screwed over its course, i.e. from the start of the active surface as far as the end of the active surface, is referred to as an angle of rotation. The angle of rotation therefore predetermines the change in angle which the flange undergoes by means of the forming tool.

The helical axis can be a straight line. It then preferably runs parallel to the longitudinal axis of the main body. The helical axis may also be bent one-dimensionally, two-dimensionally or three-dimensionally. For example, the helical axis can be a circular arc segment or can have a changing bending radius. By means of the bending of the helical axis, an outer shape of the panel to be machined can be taken up, as a result of which the result of the fold forming operation is improved. For example, the radius of the circular arc segment can correspond to the mean radius of a component profile.

In order to produce the folded connection, the fold forming tool is brought into contact with the workpiece to be formed, with the active surface pressing against the flange. The fold forming tool is guided in the direction of its longitudinal axis along the flange, with the active surface continuously bending over the flange in the direction of the inner panel. The direction in which the fold forming tool is displaced here is referred to as the working direction. The flange undergoes a continuous change in angle during the deformation, with tangential entry and exit conditions for the panel being produced. The angle of rotation of the active surface makes it possible in a simple manner to define how far the flange is bent over with a single pass by the fold forming tool. It goes without saying that the direction of rotation of the helical surface is selected in accordance with the forming of the panel to be undertaken. The active surface can be wound, for example, by an angle of rotation in the range of 30 to 90 degrees, or in the range of 45 to 90 degrees, or in the range of 70 to 179 degrees.

The use of a helical surface as described above as the active surface also achieves the following technical effect: in a conventional folding operation with a crimping roller, the radius of the crimping roller is also crucial for the visual quality of the folded connection. In simplified terms, the larger the radius of the crimping roller, the smaller is the resulting corrugation in the folded-over flange. The invention now makes use of the concept that, by means of the configuration of the active surface as a helical surface described above, contact with the flange can be realized, the contact corresponding to a crimping roller with a very large radius, for example of more than 60 mm. The length of the active surface has an effect on the size of an equivalent roller diameter and is correspondingly selected. Advantageously, unlike conventional crimping rollers, the fold forming tool according to the invention does not require a rotationally symmetrical configuration. The fold forming tool can therefore be very much smaller, in particular with a smaller overall height, with an excellent visual quality of the folded connection being obtainable at the same time.

While the flange portion is guided along the active surface, the latter acts with a pressure force on the flange. The effect now also achieved by the configuration as the above-described helical surface is that the force vector applied locally by the active surface always points in the direction of the trimmed edge of the flange. By this means, the adhesive arranged in the folded connection is spread out uniformly in the direction of the trimmed edge of the flange and emerges with a more laminar flow. The trimmed edge can preferably also be bonded into the folded/bonded connection by the emerging adhesive. The emerging adhesive is distinguished by a homogeneous crest line. Emerging adhesive accumulates in the vicinity of the flange edge and preferably covers the end side of the flange. This not only achieves a folded/bonded connection of high quality, but also forms protection against corrosion of the trimmed edge in the same method step.

During the folding over of the flange, the latter follows the shape of the above-described helical surface and the material undergoes stretching, in particular at the trimmed edge. The extent of the occurring stretching of the material is influenced by the slope of the active surface resulting from the active surface length, the angle of rotation and the width of the flange. If too large a slope is selected, the material would be excessively stretched and would therefore cause corrugation of the folded connection or self-locking of the tool. However, for a compact design of the tool, the slope should not be selected to be too small. A person skilled in the art can select suitable slopes on the basis of the individual joining situation. In tests, for a flange width of 10 mm and an angle of rotation of 90 degrees, it has proven expedient, for example, if the active surface length is 60 mm. For a flange width of 15 mm and an angle of rotation of 90 degrees, an active surface length of 90 mm has been shown to be expedient.

In one refinement, the fold forming tool has two opposed active surfaces which are arranged one behind the other in the direction of the longitudinal axis. Each of the active surfaces is configured as an above-described helical surface. As viewed along the longitudinal axis, one active surface therefore has a profile rotating to the right and the other active surface a profile rotating to the left. With a fold forming tool of this type, it is possible for work to be carried out in both directions, and therefore the use possibilities of the tool are increased.

In one refinement, the active surface is designed as a surface which is fixed with respect to the main body. The active surface can preferably be part of the main body and, for example, a surface of the main body. Such a configuration can be produced particularly cost-effectively. In this refinement, the flange and active surface slide along each other. In order to reduce corrugations in the formed flange, the active surface can be additionally coated or wetted with a substance reducing static friction.

In a further refinement, the active surface contains two or more rollers, in particular a multiplicity of rollers, which are arranged rotatably in the main body. This reduces the friction between the tool and workpiece during the forming. The rollers can preferably be designed as needle rollers, for example in the form of cylindrical metal pins, which are accommodated in corresponding depressions of the main body and are rotatable about their longitudinal axis. Needle rollers provide a high load-bearing capacity with a simultaneously small construction height. The active surface can be formed exclusively by the rollers or needle rollers and then only the roller surfaces or needle roller surfaces come into contact with the flange during the forming thereof. Alternatively, the rollers or needle rollers together with a surface of the main body can also form the active surface.

Preferably, each roller or needle roller is arranged inclined with its axis of rotation about an angle in relation to the longitudinal axis of the main body. In one refinement, the angles are standard for all of the rollers or needle rollers of an active surface.

In an alternative refinement, the axes of rotation of the rollers or needle rollers have different angles in relation to the longitudinal axis of the main body, said angles becoming smaller over the course of the active surface. The course of the active surface is intended to be defined here by the direction in which the fold forming tool is guided for folding over the fold. In other words, the axes of rotation of the rollers or needle rollers can be, for example, twisted with respect to one another. By the rollers or needle rollers being positioned ever more shallowly with respect to the longitudinal axis, the vector at which the adhesive is pushed in the direction of the trimmed edge also changes, and therefore the emergence of the adhesive can be set in a specific way.

It may be advantageous in this connection if the angle about which the axes of rotation of the rollers or needle rollers are inclined in relation to the longitudinal axis of the main body is in a range of 20° to 90° or in a range of 35° to 55°.

The fold forming tool can furthermore have a contact surface for bearing against the flange to be bent over. The contact surface is preferably arranged at an angle to the active surface. In order to fold over the flange, the fold forming tool is guided, for example, with the contact surface onto the flange edge and brought into contact therewith. The fold forming tool is then guided in the direction of its longitudinal axis along the flange edge, with the contact between the contact surface and flange edge being maintained. Guiding of the fold forming tool is thus realized in a particularly simple and cost-effective manner, as a result of which the process repetition accuracy can be increased.

Furthermore, a fold forming device is specified with a fixing apparatus which is designed for fixing an outer panel having a flange and for fixing an inner panel, and with a multi-axial manipulator, the hand of which bears a fold forming tool according to the invention. The fold forming device is furthermore designed to move the fold forming tool along a predetermined route. The fold forming tool is preferably moved along the flange of the outer panel and bends the flange over in the direction of the outer panel. For this purpose, the fold forming device has, for example, a control device which is programmed to position and to move the fold forming tool in a suitable manner.

The fixing apparatus can be designed, for example, as a holding-down means which is stationary relative to the outer panel and inner panel during the folding process.

Alternatively, the fixing apparatus can also be moved together with the fold forming tool and can thus fix the components in the immediate vicinity of the machining location. In such a solution, the fixing apparatus comprises, for example, a pressing element arranged on the fold forming tool, for example a pressure roller or a sliding runner. This pressing element is moved by the manipulator together with the fold forming tool and presses inner panel and outer panel onto each other.

In a further aspect of the invention, a method for producing a folded/bonded connection is specified. The method comprises the steps of:

- providing an outer panel having a flange,
- arranging at least one edge region of an inner panel on the outer panel,
- arranging an adhesive on the edge region of the inner panel, and
- folding the flange over the edge region of the inner panel, for which purpose an above-described fold forming tool is brought with its active surface into contact with the flange of the outer panel and is moved in the direction of its longitudinal axis along the flange.

The flange is preferably a portion which is bent over in relation to the remaining outer panel and is typically bent over by substantially 90 degrees. However, other bending-over angles are also possible. In the method, this flange is bent over further in the direction of the outer panel and of the inner panel, which is arranged thereon. This can take place in one or more steps. A particular advantage of the fold forming tool according to the invention lies in the fact that selection of an appropriate angle of rotation of the active surface means that complete forming of the flange, including protection against corrosion, is possible in just a single method step. This can save on tool costs and the process time can be reduced, and therefore the resulting method is particularly cost-effective.

The adhesive is applied before the crimping of the flange and can be arranged, for example, on the outer panel and/or the inner panel. The applied quantity of adhesive is preferably dimensioned in such a manner that a degree of filling of the flange connection of more than 200, preferably 220 to 230 is achieved. The degree of filling is a measure of how much the flange connection is filled with adhesive. At a degree of filling of 200, the quantity of adhesive is dimensioned in such a manner that the adhesive reaches as far as the flange edge, but no adhesive emerges. It has turned out that, at a degree of filling of 200 or higher in combination with the above-described fold forming tool, the flange edge of the outer panel is completely wetted with adhesive. At a degree of filling in the range of 200 to 230, the emerging quantity of adhesive also accumulates closely along the component edge, and therefore no significant finishing work to remove excess adhesive has to be undertaken.

The above-described method achieves excellent protection against corrosion in the edge region because of the slower emergence of the adhesive, and therefore the method is suitable in particular for producing folded/bonded connections in automobile manufacturing. The inner panel and the outer panel are preferably formed from a metallic material or a metal alloy. The inner panel and the outer panel can be sheet-metal components preferably provided with a corrosion protection layer. They are preferably trimmed by a punching or cutting method. In one refinement, the trimmed edges of the outer panel that are adjacent to the front side of the flange portion can advantageously be rounded. It is particularly preferred if both trimmed edges of the cut surface are rounded. The rounding may be, for example, deburring of the edges. Rounded should be understood as meaning that the trimmed edges are no longer sharp edges. This results in better wetting of the edges with a cathodic dip-paint coating and paint. In combination with the use of the fold forming tool according to the invention, the uniform emergence of the adhesive during the folding operation and the formation of a homogeneous crest line are also assisted. The trimmed edge on the folded connection side can also be bonded into the folded/bonded connection in particular by the emerging adhesive.

In one refinement, the outer panel and the inner panel are vehicle components. The vehicle components may in particular be body components, for example a side frame and a profile rail, or add-on parts, for example the inner and outer panels of a door or of a front flap/tailgate. Conventionally, vehicle components of this type have complex geometries and poor accessibility. Use of the above-described fold forming tool makes it possible to produce folded/bonded connections with excellent mechanical and visual properties even in such difficult joining conditions. In addition, the fold forming tool permits automation of the method, for example with the above-described fold forming device within the scope of manufacturing suitable for manufacturing on a large scale.

In a further aspect, a vehicle is specified, having a folded/bonded connection. The folded/bonded connection comprises an outer panel which is bent over with a flange and is adhesively bonded thereto. In the region of the folded/bonded connection, the outer panel forms an outer skin portion of the vehicle body. In particular, the outer panel forms a vehicle outer surface in the direct viewing region. The direct viewing region is in particular the vehicle outer surface which is classified as assessment area P0 or P1 in BMW Group Standard GS 97103-2_2020-05. The outer panel may form, for example, a wheel arch. The outer skin is visible to the viewer on the finished vehicle and therefore particularly high visual requirements are imposed on the outer skin. Covers are frequently used here to cover the folded/bonded connection. Vehicle regions not accessible up to now for a classic crimping tool, e.g. the door sill, which have had to be covered retrospectively by sealing strips, can be reached by the novel tool. The coverings can now be omitted. The crimping can be shown without a covering by the omission of PVC in the immediate vicinity of functionally challenging regions, e.g. a lowerable side window.

As described above, the stretching of the material can be reduced to a minimum and the adhesive can emerge homogeneously, the adhesive wetting at least the trimmed edge facing the interior of the folded connection and, in addition to the bonding effect, ensuring reliable protection against corrosion. Owing to the improved optics of the folded/bonded connection, the possibility arises of dispensing with a (plastics) cover to be mounted retrospectively, as a result of which completely novel visual creative freedom is provided.

In a preferred refinement, the outer panel having the flange is bent around an inner panel which is adhesively bonded to the outer panel. For this purpose, the inner panel is positioned on the outer panel before the formation of the folded/bonded connection, and the fold is subsequently bent over onto the inner panel. Designs of this type are used, for example, in the region of the door frame or side frame, the sill or in the case of add-on parts, such as vehicle flaps.

In one refinement, the vehicle body has a further folded/bonded connection at which the outer panel is bent around a further panel and is adhesively bonded thereto. The outer panel in the region of both folded/bonded connections preferably forms an outer skin portion of the vehicle body.

As already described for the method, it is also preferred for the vehicle that the trimmed edges of the outer panel are rounded in the region of the flange which is to be bent over. Advantages arise upon the emergence of the adhesive and the wetting of the trimmed edge with the adhesive. The inner trimmed edge is protected against corrosion by the adhesive, and the outer trimmed edge is protected against corrosion in the cathodic dip-paint bath and by the retrospective application of paint. This obviates the need to apply additional PVC sealing to the folded/bonded connection in order to protect the trimmed edge and thus, in one refinement, the folded/bonded connection can be free from PVC sealing.

In a further refinement, the invention makes it possible for the course of the folded/bonded connection to follow the strake. The strake of a vehicle is the geometrical representation of all of the surfaces visible to the customer in the interior and exterior taking into consideration all of the technical and formal-esthetic demands.

The folded/bonded connection on the vehicle can be produced preferably using the above-described fold forming tool or the above-described fold forming device, and/or using the above-described method and achieves the technical effects and advantages described there.

Features and details which are described in conjunction with the fold forming tool or the fold forming device also apply in conjunction with the method according to the invention, and vice versa in each case, such that reference is always or can always be made reciprocally with respect to the disclosure of the individual aspects of the invention.

Further advantages, features and details of the invention emerge from the description below in which exemplary embodiments of the invention are described in detail with reference to the drawings. The features mentioned in the claims and in the description can be essential to the invention in each case individually by themselves or in any desired combination. If the term "can" is used in this application, it refers both to the technical possibility and to the actual technical implementation.

Exemplary embodiments are explained below with reference to the attached drawings.

DETAILED DESCRIPTION OF THE DRAWINGS

Figure 1:
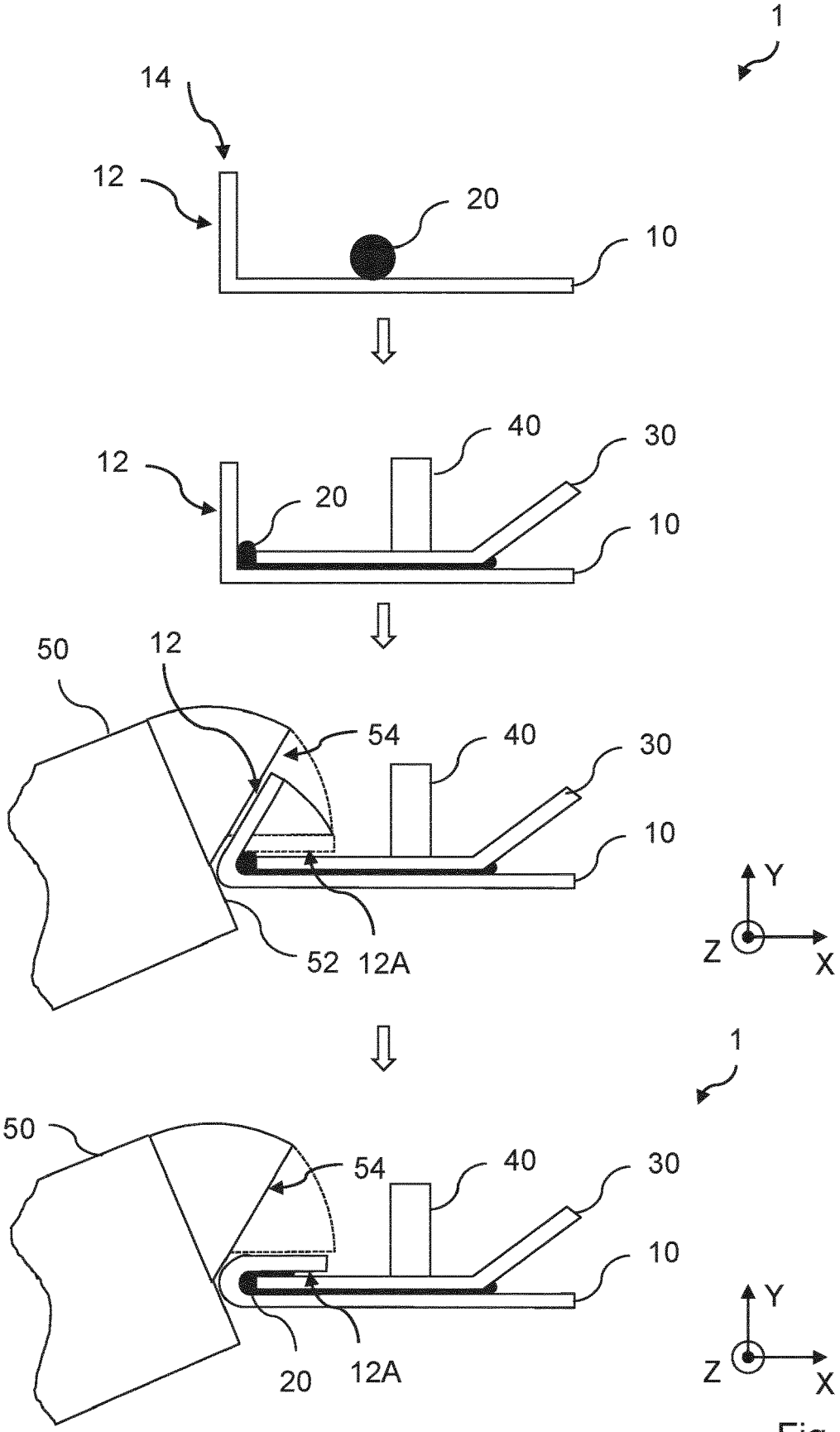
FIG. 1 is a schematic illustration of a method for producing a folded/bonded connection.

In an exemplary method for producing a folded/bonded connection 1, first of all an outer panel 10 having a flange 12 is provided, to which an adhesive 20 is applied in the region of the folded connection to be formed. The trimmed edge of the outer panel is preferably rounded, but this is not illustrated here for illustrative reasons. An inner panel 30 is then arranged with respect to the outer panel 10 in such a manner that an edge region of the inner panel 30 comes to lie on the outer panel 10. The panels 10 and 30 are fixed with respect to each other by a fixing apparatus 40. A fold forming tool 50 is now guided with its contact surface 52 to the flange 12 and guided along the flange 12 in the direction of a longitudinal axis of the fold forming tool 50. The longitudinal axis corresponds in FIG. 1 to the z axis of the coordinate system shown.

In FIG. 1, the fold forming tool 50 is moved out of the plane of the sheet. During the movement of the fold forming tool 50, the latter presses with its active surface 54 against the flange 12 and bends the latter over in the direction of the inner panel 30. The active surface 54 is configured as a helical surface according to the invention and as described above. In this case, the helical axis is a straight line and runs into the plane of the figure, and the active surface 54 is designed as a helical surface rotating to the right. The course of the active surface 54 means that the flange 12 is bent over continuously from the starting position into an end position 12A during the pass with the fold forming tool 50.

Figure 2:
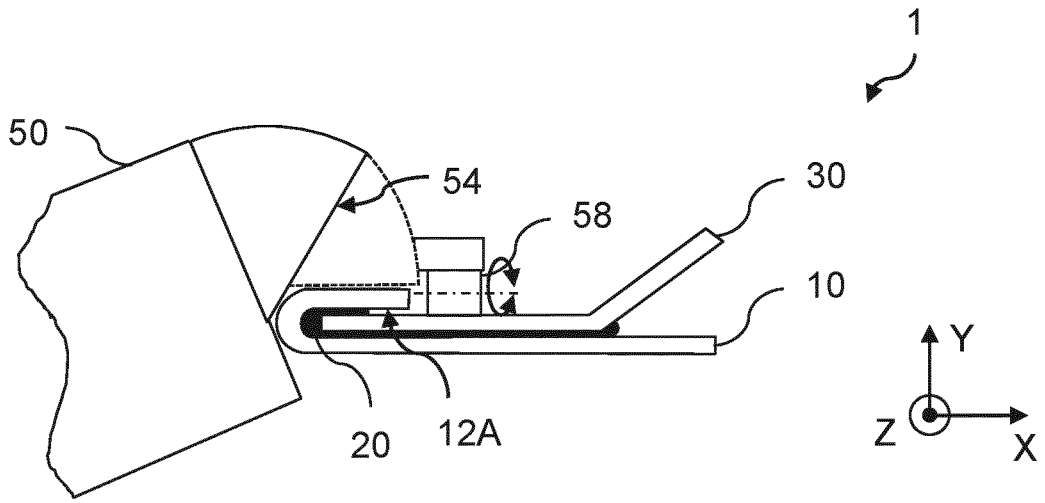
FIGS. 2 to 5 show exemplary refinements of a fold forming tool.

FIG. 2 shows a variation of the fold forming tool 50, in which the latter also has a pressing element 58 which is arranged on the fold forming tool 50. During the use of the fold forming tool 50, the pressing element 58 presses the inner panel onto the outer panel and thus ensures that the panels are fixed with respect to each other. The pressing element 58 is designed in FIG. 2 by way of example as a pressure roller, the axis of rotation of which is arranged in the x direction, and therefore the pressure roller can roll on the panel during the folding. Alternatively, the pressing element can also be designed as a sliding runner.

Figure 3:
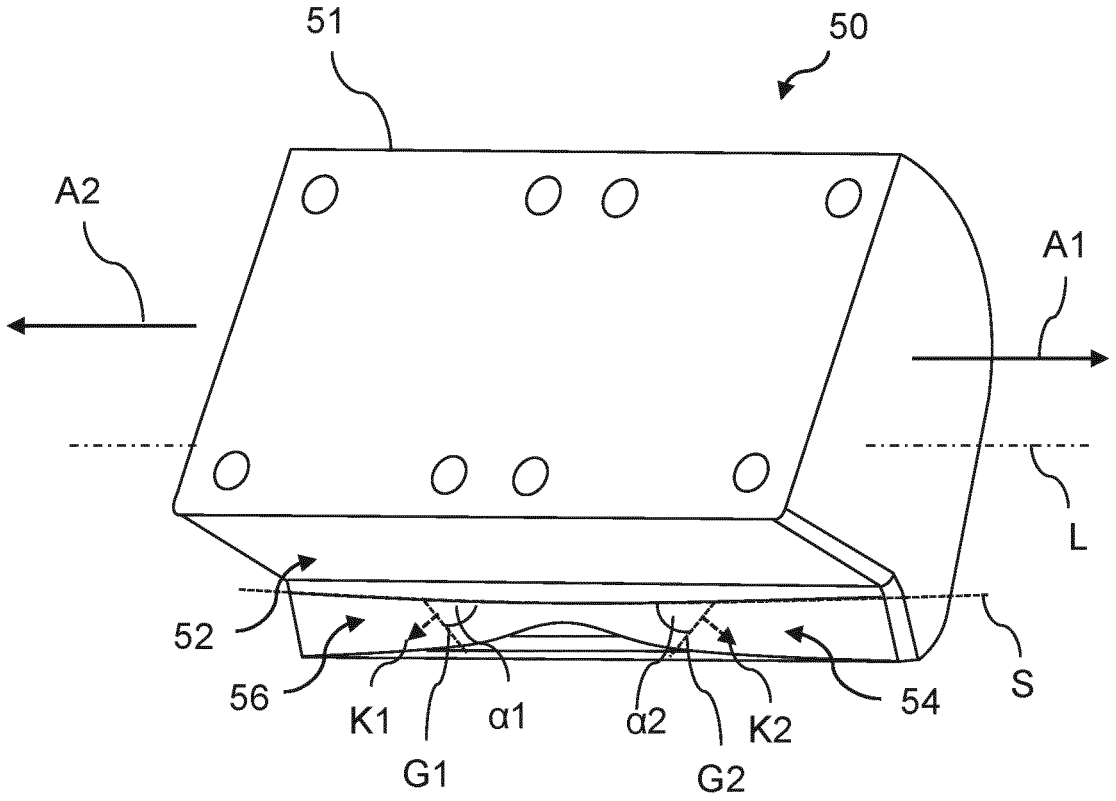
Figure 4:
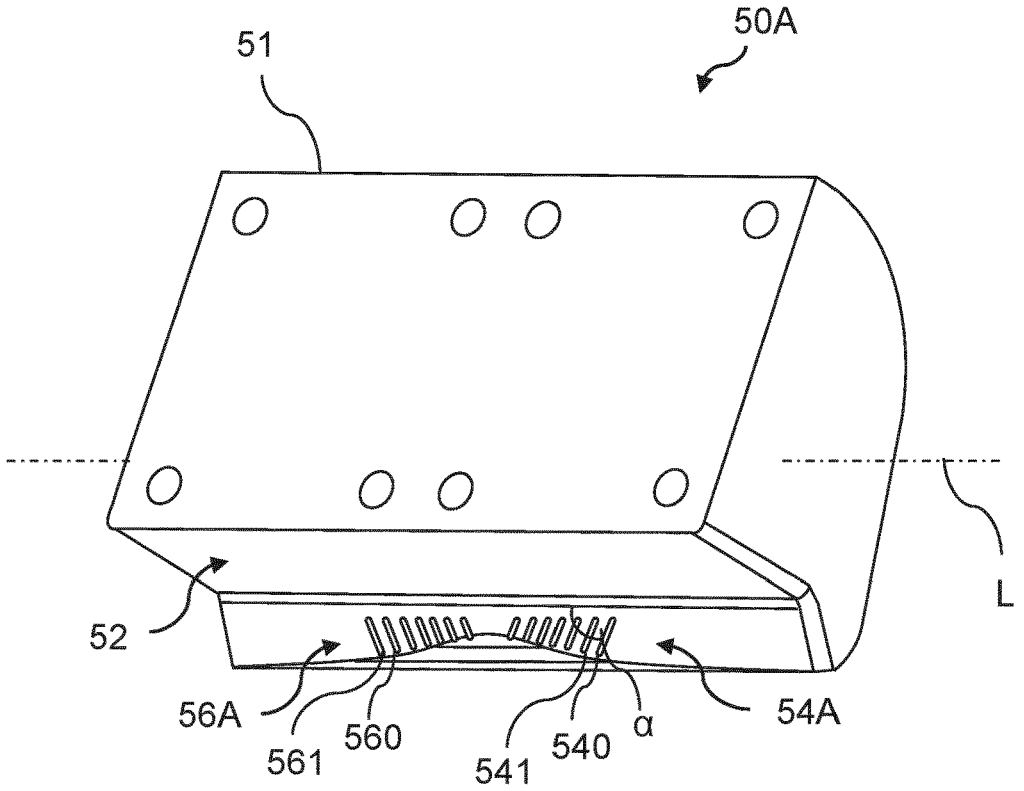
Figure 5:
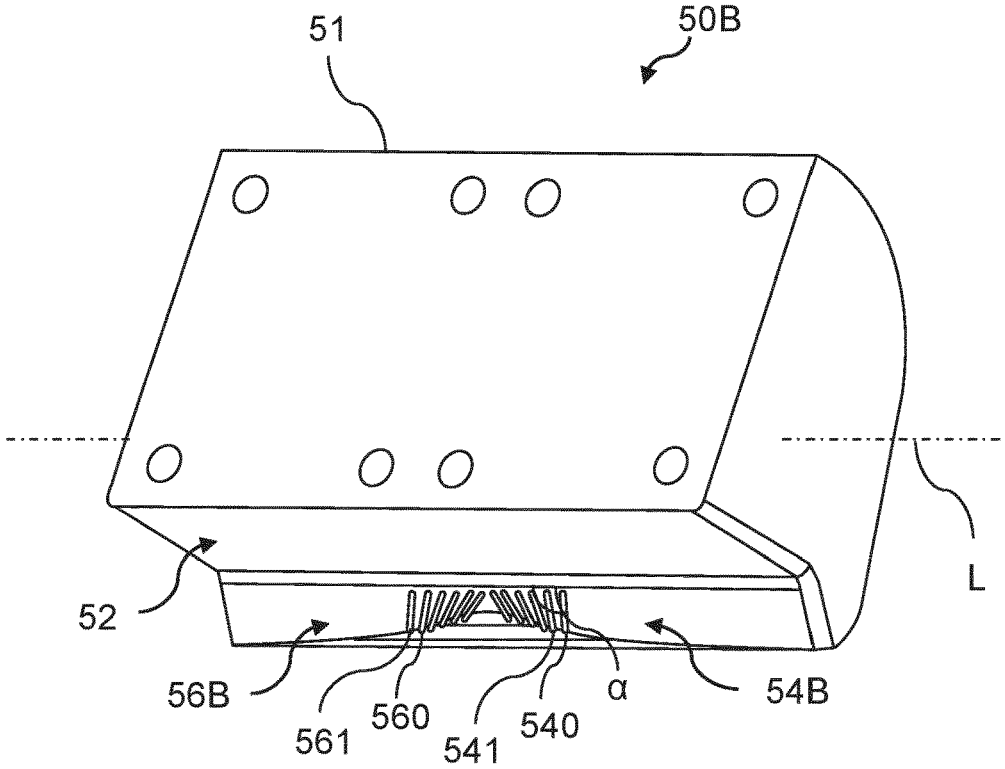

FIGS. 3 to 5 show three exemplary refinements of a fold forming tool. The same reference signs refer to the same features, and therefore the latter are not described again. The fold forming tools 50, 50A and 50B each have a main body 51 with a longitudinal axis L. The main body 51 also has a surface 52.

At an angle to the surface 52, the fold forming tools 50, 50A and 50B each have active surfaces 54, 54A, 54B and 56, 56A, 56B with which the forming of the flange 12 takes place. Each of the fold forming tools 50, 50A and 50B has two active surfaces arranged one behind the other along the longitudinal axis L. Each active surface is designed as a helical surface described below, wherein the active surfaces 54, 54A and 54B are formed rotating to the right, and the active surfaces 56, 56A and 56B are formed rotating to the left. The helical surface is produced by screwing a straight line G1 or G2 about the helical axis S. In this case, the helical axis S is a curved axis and has the form of a circular arc segment. Alternatively, the helical axis S may also be a straight line which preferably runs parallel to the longitudinal axis of the main body 51. The straight lines G1 and G2 intersect the helical axis S and—as viewed in the working direction A1 or A2 of the fold forming tool—are inclined at an acute angle $\alpha 1$ or $\alpha 2$ in relation to the helical axis S. For example, the angle of inclination by which the straight line G1 or G2 intersects the helical axis S is in the range of 20 to 70 degrees and in particular in the range of 50 to 70 degrees and particularly preferably is 60°. By this means, the resulting force vector K1 or K2 acts in the direction of the trimmed edge.

The opposed active surfaces permit the use of the fold forming tool in both directions. The course of the active surfaces is in each case from the edge of the fold forming tool into the center. The active surfaces 54, 54A and 54B are therefore used when the fold forming tool is pushed to the right in the plane of the image. Conversely, the active surfaces 56, 56A and 56B are used if the fold forming tool is pushed to the left in the plane of the image. Alternatively, the fold forming tools can also be formed only with one active surface 54, 54A, 54B or 56, 56A, 56B.

In the case of the fold forming tool 50 according to FIG. 3, the active surfaces 54 and 56 are designed as part of the main body 51 and are therefore a surface which is fixed with respect to the main body 51. During the folding operation, the flange 12 slides over the active surface 54 or 56. The pressing element 58 is not depicted in the illustration in FIG. 3.

In the case of the fold forming tools 50A and 50B in FIGS. 4 and 5, needle rollers 540, 541, . . . and 560, 561, . . . are additionally arranged in the helical surface. The needle rollers are mounted rotatably in the control helical surface, as a result of which the friction of the active surfaces 54A, 54B, 56A and 56B with respect to the flange 12 is reduced. The needle rollers are arranged inclined with their axes of rotation in each case by an angle $\alpha$ in relation to the longitudinal axis L of the main body 51. In each case 6 needle rollers are illustrated per active surface in FIGS. 4 and 5. This is purely by way of example; it is also possible for two or more needle rollers up to a multiplicity of needle rollers, e.g. more than 10 per active surface, to be provided.

In the case of the fold forming tool 50A according to FIG. 4, the angles are standard for all of the needle rollers of an active surface. In the case of the fold forming tool 50B according to FIG. 5, the angles become smaller over the course of the active surfaces 54B or 56B. The needle rollers assist a targeted squeezing out of excess adhesive. The angle $\alpha$ preferably lies in a range of 20° to 90° or in a range of 35° to 55°. The fold forming tools 50A and 50B can likewise have a pressing element 58.

Figure 6:
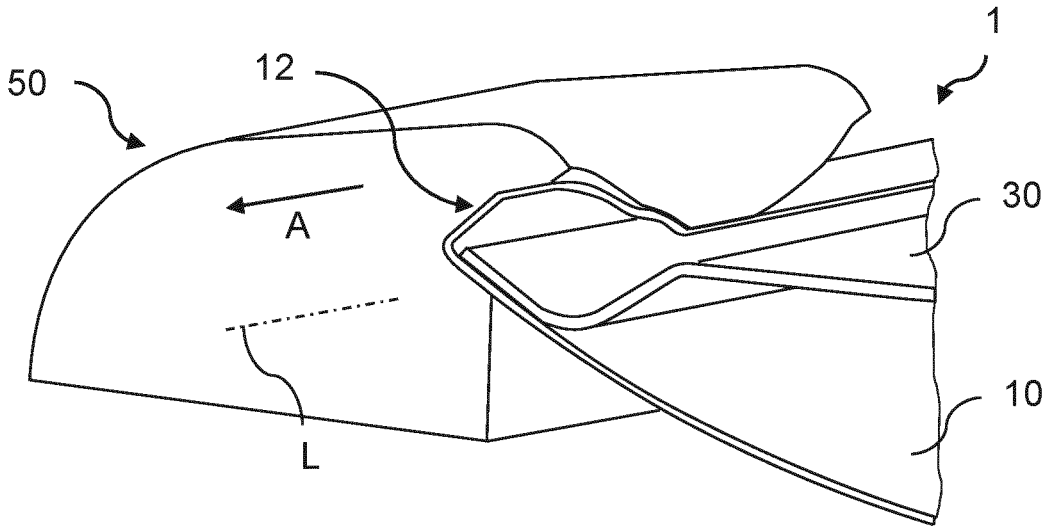
FIG. 6 is a sectional view of an exemplary folded/bonded connection.

FIG. 6 shows an exemplary folded/bonded connection 1 during the formation of same. The fold forming tool 50 is moved along the flange edge in working direction A, as a result of which the flange 12 is bent over in the direction of the inner panel. The angle of rotation of the active surface 54 is dimensioned in such a manner that the flange 12 is folded over completely by being passed over once by the forming tool 50. Owing to the configuration of the active surface 54 as an above-described helical surface, the adhesive (not illustrated here) emerges particularly uniformly and wets the end side of the flange 12, as a result of which good protection against corrosion is achieved.

Figure 7:
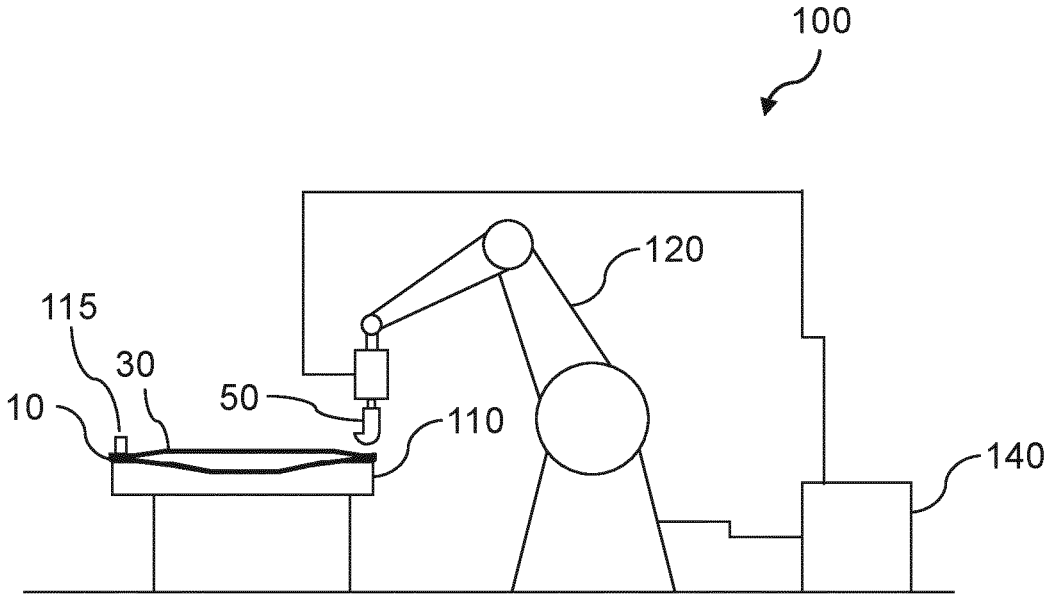
FIG. 7 is an exemplary fold forming device.

FIG. 7 shows an exemplary fold forming device 100 with a crimping bed 110 on which the outer panel 10 and the inner panel 30 are arranged and fixed by means of a fixing apparatus 115. Alternatively or additionally, in order to fix the panels, use can also be made of a fold forming tool with a pressing element 58, the pressing element 58 then acting as the fixing apparatus. Furthermore, the fold forming device 100 has a manipulator 120 in the form of an industrial robot, on the hand axis of which a fold forming tool 50 is arranged. Alternatively, the fold forming tools 50A or 50B can also be used. The fold forming device 100 furthermore has a control device 140 which is operatively connected to the manipulator 120 and to the fold forming tool 50. The control device 140 is designed, e.g. programmed, in order to move the fold forming tool relative to the fixing apparatus 115 or the panels 10 and 30 and, in the process, to bend over the flange 12 to produce the folded/bonded connection 1.

Figure 8:
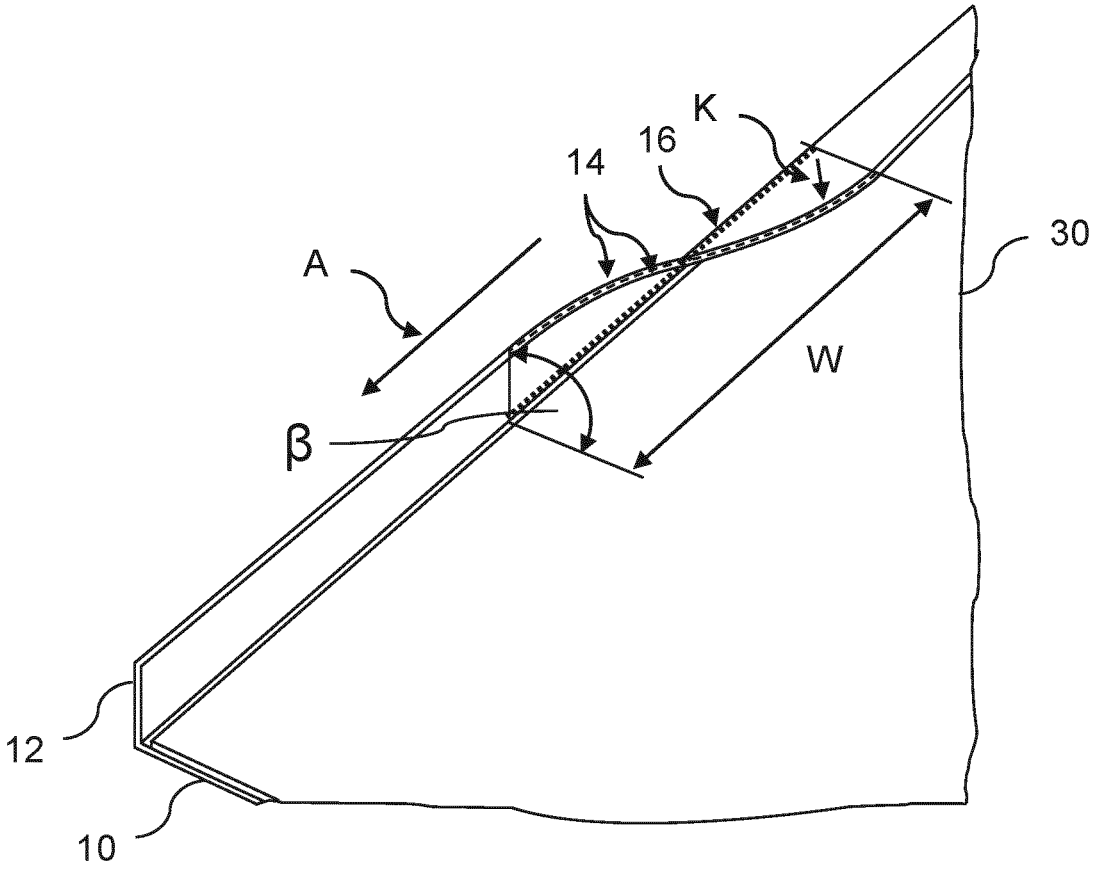
FIG. 8 shows an exemplary panel arrangement during the formation of the folded/bonded connection.

FIG. 8 shows an exemplary folded/bonded connection at a time at which only part of the fold is bent over, in order to show the operative mechanisms acting in the method. The above-described fold forming tool (not illustrated here) is guided in the working direction A (illustrated by the arrow) along the fold edge and parallel to the latter. In this case, the flange 12 is continuously folded over in the direction of the inner panel 30 in accordance with the angle of rotation of the fold forming tool. In FIG. 8, the angle of rotation $\beta$ is by way of example 90°, and the flange 12 which was previously angled at a right angle is deposited on the inner panel 30 after the pass with the fold forming tool. The angle of rotation $\beta$ therefore predetermines the change in angle which the flange 12 undergoes by means of the forming tool. Of course, the angle of rotation $\beta$ can also have different angles, preferably in a range of 30-90°, or in a range of 45-90°. The angle of rotation can also cover very much larger angular ranges, for example a range of 70°-179°.

By means of the use of the fold forming tool according to the invention, which is guided parallel to and along the flange edge, the force vector K acting on the flange permanently acts in the direction of the trimmed edge 14 during the folding over of the flange. Adhesive which is arranged in the region of the folded connection is thereby pressed uniformly in the direction of the trimmed edge 14, as a result of which uniform wetting of the panels with adhesive is achieved. To improve the emergence of the adhesive, the trimmed edges 14 are preferably rounded. Furthermore, excess adhesive emerges substantially uniformly at the trimmed edge 14, thus resulting in a uniform crest line. Soiling of the panels is avoided and, in addition, the trimmed edge is protected by the adhesive which has emerged. In particular, the trimmed edge which faces the folded/bonded connection is wetted with adhesive. The trimmed edge which faces away therefrom, because of its rounding, is readily protected against corrosion by the cathodic dip-paint coating and paint. It follows from this that more extensive protection against corrosion in the form, e.g., of PVC sealing of the folded connection can be dispensed with.

During the folding over of the flange 12, the latter follows the helical surface form of the active surface and the material undergoes stretching, in particular at the trimmed edge 14. The stretching is shown in FIG. 8 by the dashed line at the trimmed edge and the dotted line at the bending edge 16, the lengths of which differ by the extent of the stretching. The extent of the stretching of the material which occurs is influenced by the slope of the active surface which arises from the active surface length W, the angle of rotation $\beta$ and the width B of the flange 12. A slope selected to be too large would excessively stretch the material and would therefore cause corrugation of the folded connection or self-locking of the tool. For a compact design of the tool, the slope should not be selected to be too small either. In tests, for a flange width of 10 mm and an angle of rotation of 90 degrees, it has proven expedient, for example, if the active surface is formed over a length W of 60 mm. For a flange width of 15 mm and an angle of rotation of 90 degrees, an active surface length W of 90 mm has been shown to be expedient.

Figure 9:
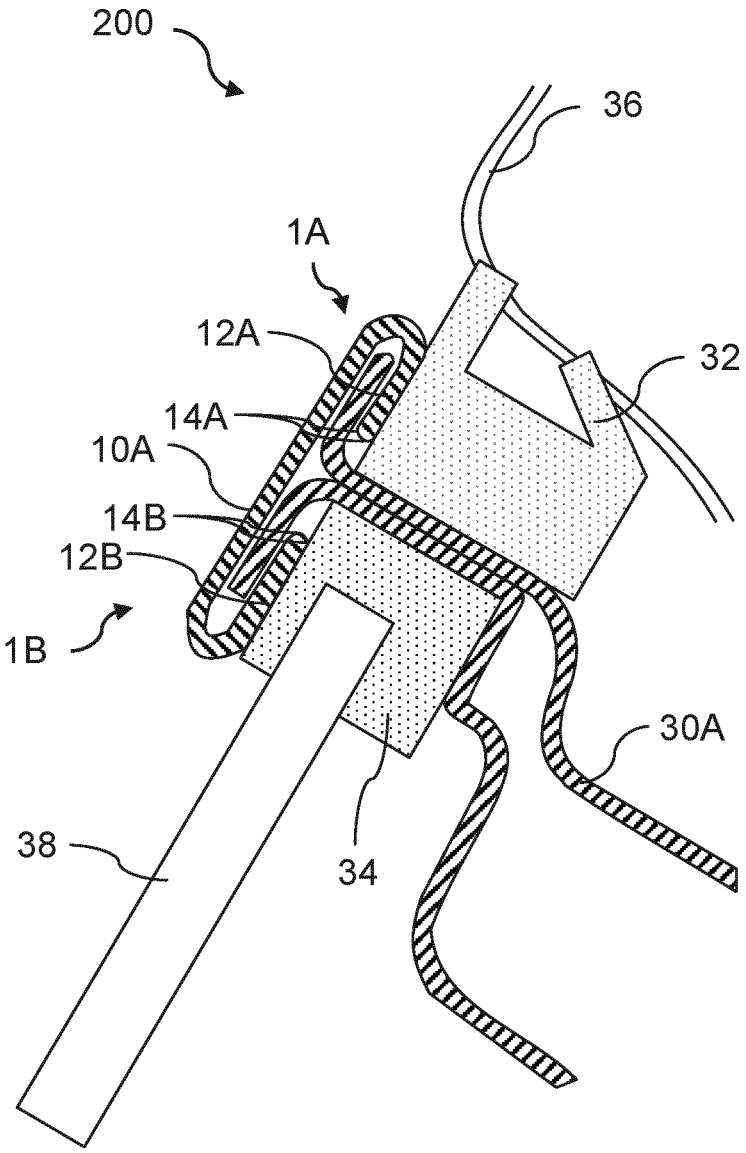
FIG. 9 is a sectional view of an exemplary folded/bonded connection in a vehicle.

FIG. 9 shows further exemplary folded/bonded connections 1A and 1B. Both folded/bonded connections have been formed with the above-described fold forming tool 50, 50A or 50B. The outer panel 10A is in each case bent with a flange 12A, 12B around an inner panel and adhesively bonded with an adhesive, not illustrated. The trimmed edges 14A and 14B of the outer panel, which are bonded into the folded/bonded connections 1A, are preferably rounded. The inner panel 30A is, for example, a door frame of the motor vehicle. Furthermore, seals 32, 34 are provided which seal the door in relation to the body 36 and a vehicle window 38.

Figure 10:
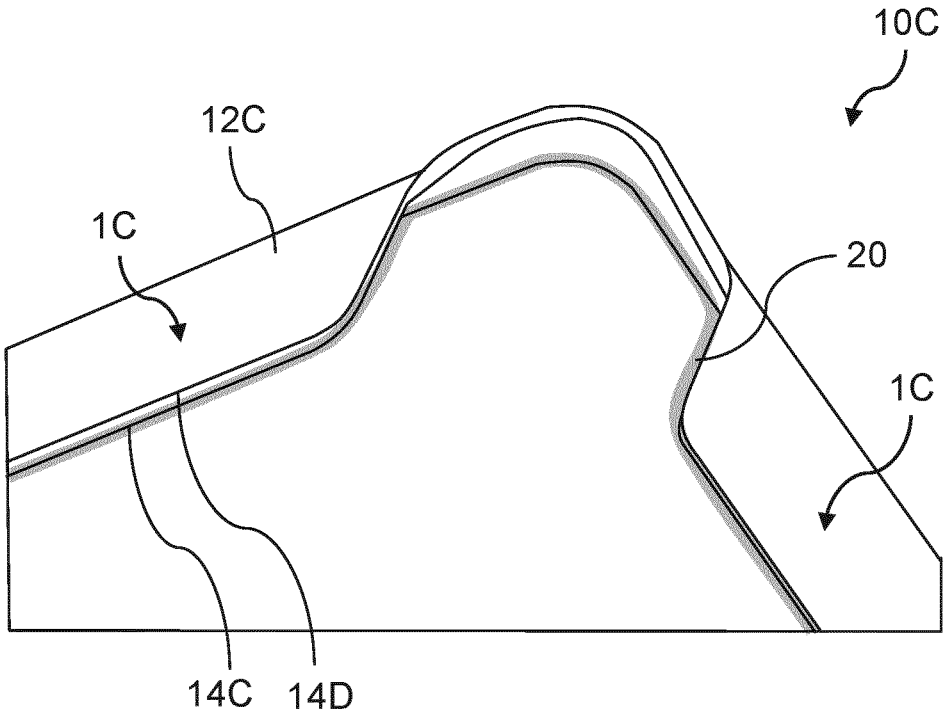
FIG. 10 shows a further exemplary folded/bonded connection in a vehicle.

FIG. 10 shows a further folded/bonded connection 1C for illustrating the new corrosion protection concept which is possible by means of the invention. The corner of an outer panel 10C that forms a bodyshell part is illustrated. The outer panel 10C has a folded/bonded connection 1C at each of its longitudinal sides. The folded/bonded connections are preferably formed with the fold forming tool 50 according to the invention. The outer panel 10C is bent over with a flange portion by substantially 180 degrees. An adhesive 20 is arranged between the flange portion and opposite outer panel portion. The trimmed edges 14C and 14D of the outer panel 10C are rounded. By this means, the adhesive 20 has emerged with a rectilinear crest line from the fold and has wetted the adjacent trimmed edge 14C. The narrow gap of the folded connection and the inner trimmed edge 14C are therefore protected against corrosion by the adhesive 20. The trimmed edge 14D facing away from the folded/bonded connection is protected against corrosion by a cathodic dip-paint coating and paint. This novel concept makes it possible to dispense with more extensive protection against corrosion, and the folded/bonded connection 1C can remain in particular without PVC sealing, i.e. free from PVC sealing.

Figure 11:
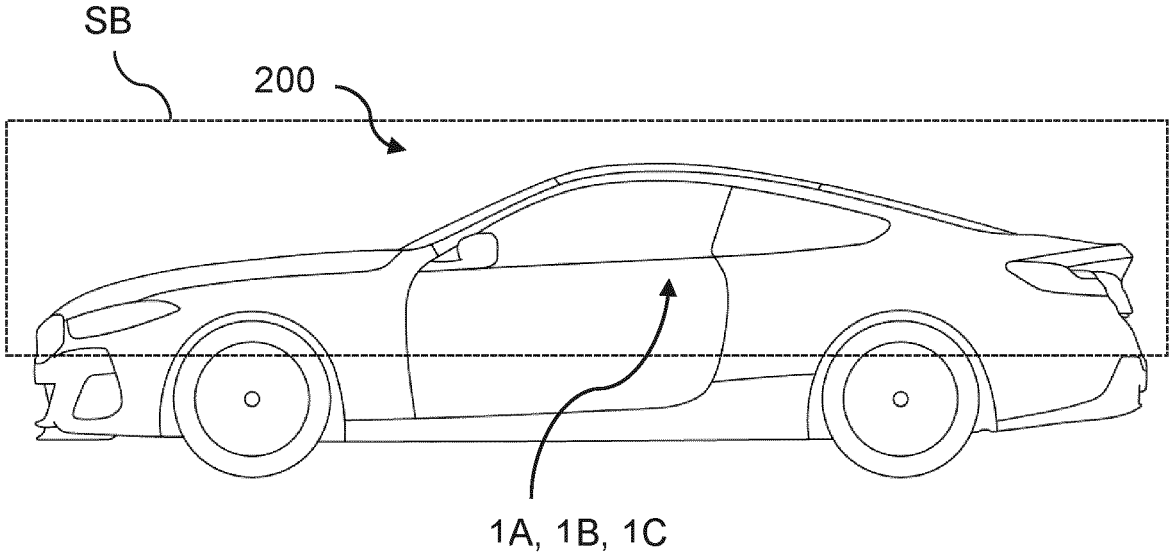
FIG. 11 shows an exemplary vehicle with a folded/bonded connection.

FIG. 11 shows an exemplary motor vehicle 200 with an exemplary folded/bonded connection 1, 1A, 1B or 1C. Since the outer panel does not have to be covered because of the high surface quality of the folded/bonded connections 1, 1A, 1B or 1C, but rather can itself be used in the manner of a decorative cover, conventional covers to be mounted retrospectively can be dispensed with. In addition, the folded/bonded connections can be in particular free from PVC sealing. The profiles of the folded/bonded connections 1, 1A, 1B, 1C can be designed to follow the strake and in particular can be part of the vehicle outer skin. Particularly preferably, the folded/bonded connection forms a vehicle outer surface in the direct visible region SB of the vehicle. The vehicle outer surface can be, by way of example, a wheel arch, a door frame, a side frame, a sill or an add-on part.

List of Reference Signs

1, 1A, 1B, 1C folded/bonded connection
10, 10A, 10C outer panel
12, 12A, 12B flange
14, 14A trimmed edges
20 adhesive
30, 30A inner panel
32, 34 seal
36 body
38 vehicle window
40 fixing apparatus
50, 50A, 50B fold forming tool
51 main body
52 surface
54, 54A, 54B, 56, 56A, 56B active surface
540, 541, . . . 560, 561 needle rollers
58 pressing element
100 fold forming device
110 crimping bed
115 fixing apparatus
120 manipulator
140 control device
200 vehicle
α, α1 angle
A, A1, A2 working direction
B flange width
G1, G2 straight line
K, K1, K2 force vector
L longitudinal axis
S helical axis
SB visible region
W active surface length

What is claimed is:

1. A method for producing a folded/bonded connection, the method comprising the steps of:

providing an outer panel having a flange;

arranging at least one edge region of an inner panel on the outer panel;

arranging an adhesive on the edge region of the inner panel; and folding the flange over the edge region of the inner panel via a fold forming tool that is brought with its active surface into contact with the flange of the outer panel and is moved in a direction of its longitudinal axis along the flange, the fold forming tool having:

a main body with a longitudinal axis; and an active surface positioned along an edge of the main body configured to fold over a flange, bent over from a metal sheet, onto the metal sheet by way of movement of the fold forming tool in a direction of the longitudinal axis along the flange in a working direction, wherein the active surface extends in the direction of the longitudinal axis of the main body and is in a form of a helical surface which is produced by a straight line helically wound around a rectilinear or a curved helical axis extending along the edge of the main body, wherein the straight line extends from the rectilinear or a curved helical axis at an acute angle, as viewed in the working direction.

2. The method according to claim 1, wherein an applied quantity of the adhesive is dimensioned in such a manner that a degree of filling of the folded/bonded connection of 200 or more is obtained, such that no adhesive emerges from the folded/bonded connection.

3. The method according to claim 1, wherein trimmed edges of the outer panel are rounded.

4. The method according to claim 3, wherein the outer panel and the inner panel are vehicle body components or add-on parts.

* * * * *